US006988632B2

(12) United States Patent
Hardy et al.

(10) Patent No.: US 6,988,632 B2
(45) Date of Patent: Jan. 24, 2006

(54) DEPLOYABLE BAG FOR A VACUUM BOX

(76) Inventors: Paul N. Hardy, 1113 Lakeside Dr, Sarnia, ON (CA) N7V 2V5; David G. Lobbestael, 40260 Regency St., Sterling Hts, MI (US) 48313; Michael L. Nottley, 1735 Baby RD, RR1, Sombra, ON (CA) N0P 2H0

( * ) Notice: Subject to any disclaimer, the term of this patent is extended or adjusted under 35 U.S.C. 154(b) by 0 days.

(21) Appl. No.: 10/654,788

(22) Filed: Sep. 4, 2003

(65) Prior Publication Data

US 2004/0056038 A1 Mar. 25, 2004

Related U.S. Application Data

(60) Provisional application No. 60/408,262, filed on Sep. 5, 2002.

(51) Int. Cl.
*B65D 25/14* (2006.01)

(52) U.S. Cl. ..... 220/720; 15/301; 15/353; 220/495.08; 383/3

(58) Field of Classification Search ..... 220/495.01, 220/720, 1.6, 495.08; 206/522; 383/3, 104; 15/301, 353
See application file for complete search history.

(56) References Cited

U.S. PATENT DOCUMENTS

| | | | | |
|---|---|---|---|---|
| 2,844,269 | A * | 7/1958 | Durbin | 220/565 |
| 3,931,652 | A * | 1/1976 | Navarra | 4/588 |
| 4,044,867 | A * | 8/1977 | Fisher | 190/107 |
| 4,124,136 | A * | 11/1978 | Bjelland et al. | 206/223 |
| 4,384,603 | A * | 5/1983 | Tyrer et al. | 220/4.23 |
| 4,385,953 | A | 5/1983 | Beck | |
| 4,801,213 | A * | 1/1989 | Frey et al. | 383/3 |
| 4,856,087 | A | 8/1989 | Nesbit | |
| 5,098,364 | A | 3/1992 | Schilling | |
| 5,345,622 | A * | 9/1994 | Plone | 4/588 |
| 5,729,840 | A | 3/1998 | Wu | |
| 5,752,731 | A | 5/1998 | Crone | |
| 6,061,957 | A * | 5/2000 | Takashima | 47/66.1 |
| 6,398,029 | B1 * | 6/2002 | Farison et al. | 206/522 |
| 6,513,974 | B2 * | 2/2003 | Malone et al. | 383/3 |
| 2002/0081041 | A1 * | 6/2002 | Malone et al. | 383/3 |

OTHER PUBLICATIONS

Hardy et al., U.S. Appl. No. 60/408,262, filed Sep. 5, 2002 A.D.
H.Q.N. Industrial Fabrids, Sarnia, Ontario, Canada, "Containment Tarpulins."
H.Q.N. Industrial Fabrics, Sarnia, Ontario, Canada, "Drawstring Bag Liners for Waste Containers."
H.Q.N. Industrial Fabrics, Sarnia, Ontario, Canada, "Landfill Dust Bags."
H.Q.N. Industrial Fabrics, Sarnia, Ontario, Canada, "Raincap Covers."
H.Q.N. Industrial Fabrics, Sarnia, Ontario, Canada, "Spout Liners."
H.Q.N. Industrial Fabrics, Sarnia, Ontario, Canada, "Waste Container Bag Liners."
H.Q.N. Industrial Fabrics, Sarnia, Ontario, Canada, "Waste Container Liners."

* cited by examiner

*Primary Examiner*—Joseph C. Merek
(74) *Attorney, Agent, or Firm*—Christopher John Rudy

(57) ABSTRACT

A deployable bag for a container embraces a containment web and a deployment system. In one embodiment, the deployment system embraces an inflatable bladder system that provides a plurality of ribs attached to or integrally part of the web that assist in deploying and supporting the bag in the container. Air may be employed as an inflation medium. The bag can be deployed in the container and employed as a liner. The container can be a vacuum box.

11 Claims, 6 Drawing Sheets

DEPLOYABLE BAG FOR A VACUUM BOX

CROSS-REFERENCE CLAIM OF DOMESTIC PRIORITY

This claims the benefits provided pursuant to 35 USC 119(e) of U.S. provisional patent application No. 60/408,262 filed on Sep. 5, 2002 A.D. The complete specification of that application is incorporated herein by reference.

FIELD AND PURVIEW

The present invention concerns a bag useful as a liner for a container. In a preferred embodiment, the bag has a set of inflatable ribs for deployment in and use during operation of the container. The invention also concerns making and using the bag as well as a combination of the bag and the container. The container, beneficially, can be an industrial vacuum box.

BACKGROUND TO THE INVENTION

Large vacuum boxes are employed in the industrial setting for containing suctioned wastes which often are removed and contained as a type of slurry. It frequently occurs that, when the vacuum box is to be emptied, the solids have settled and are difficult to remove from the box. Thus, reemployment of the vacuum box becomes impossible, and the vacuum box will require extensive cleaning as the waste cannot be left in the container.

In attempting to address such concerns, various vacuum box liners have been proposed. See, e.g., U.S. Pat. Nos. 4,385,953 to Beck, and 5,098,364 to Schilling. However, installation of such liners can be cumbersome and dangerous, and their use can be problematic, as most industrial vacuum box containers require confined space entry. Note, U.S. Pat. No. 5,752,731 to Crone.

It would be desirable to ameliorate or solve such problems.

FURTHER DISCLOSURE OF THE INVENTION

The present invention provides a deployable bag for a container comprising a containment web and a deployment system. The bag can be employed in the container as a liner.

The invention is useful in waste containment.

Significantly, by the invention, one or more problems in the art are ameliorated if not solved. Accordingly, disposal of industrial and/or environmental waste from containers in general and large vacuum boxes in particular is made more efficient in kind, and ready reemployment of the vacuum boxes is made possible and streamlined. By employment of the bag of the invention, nearly all of the waste entering a vacuum box can be removed readily, to notably include solids, by disposing of the bag, which serves as a liner to the box, and the contents of the bag together. Moreover, the bag of the invention is self-deployable, affording ease of installation in addition to reliability in use. Thus, most beneficially, the rigors and dangers of confined space entry can be avoided. Then too, the container can retain its full capacity, and it may be less likely to prematurely corrode, since dramatically less waste is left behind after emptying of the container. The invention is efficient to make and use.

Numerous further advantages attend the invention.

The drawings form part of the specification hereof. With respect to the drawings, which are not necessarily drawn to scale, the following is briefly noted:

Figure 1:
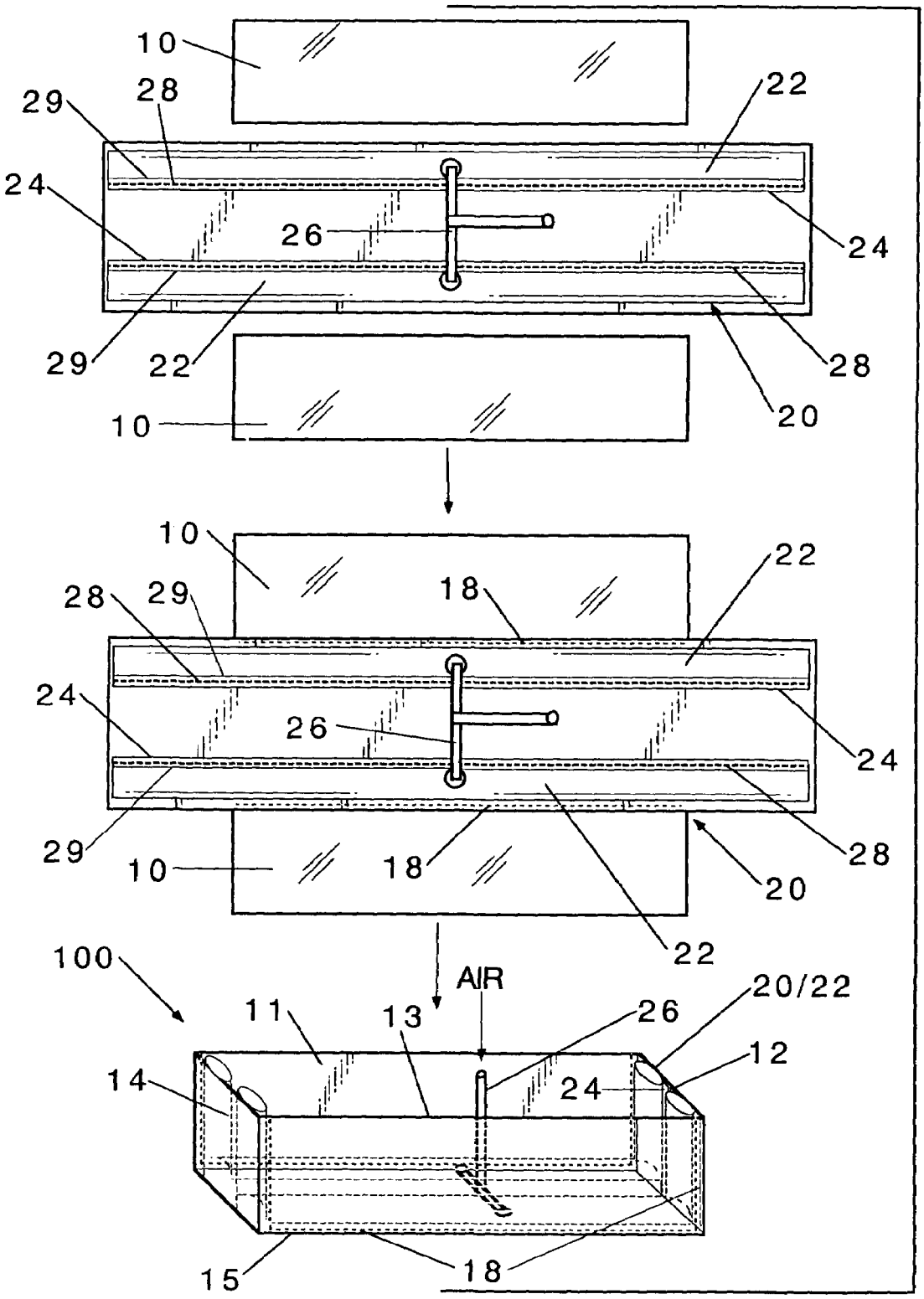
FIG. 1 is a schematic plan view of the making and test deployment of an embodiment of a deployable bag for a container of the invention, where the containment web of the bag is made from more than one piece, and the deployment system is made separate from and then attached to the web.
Figure 2:
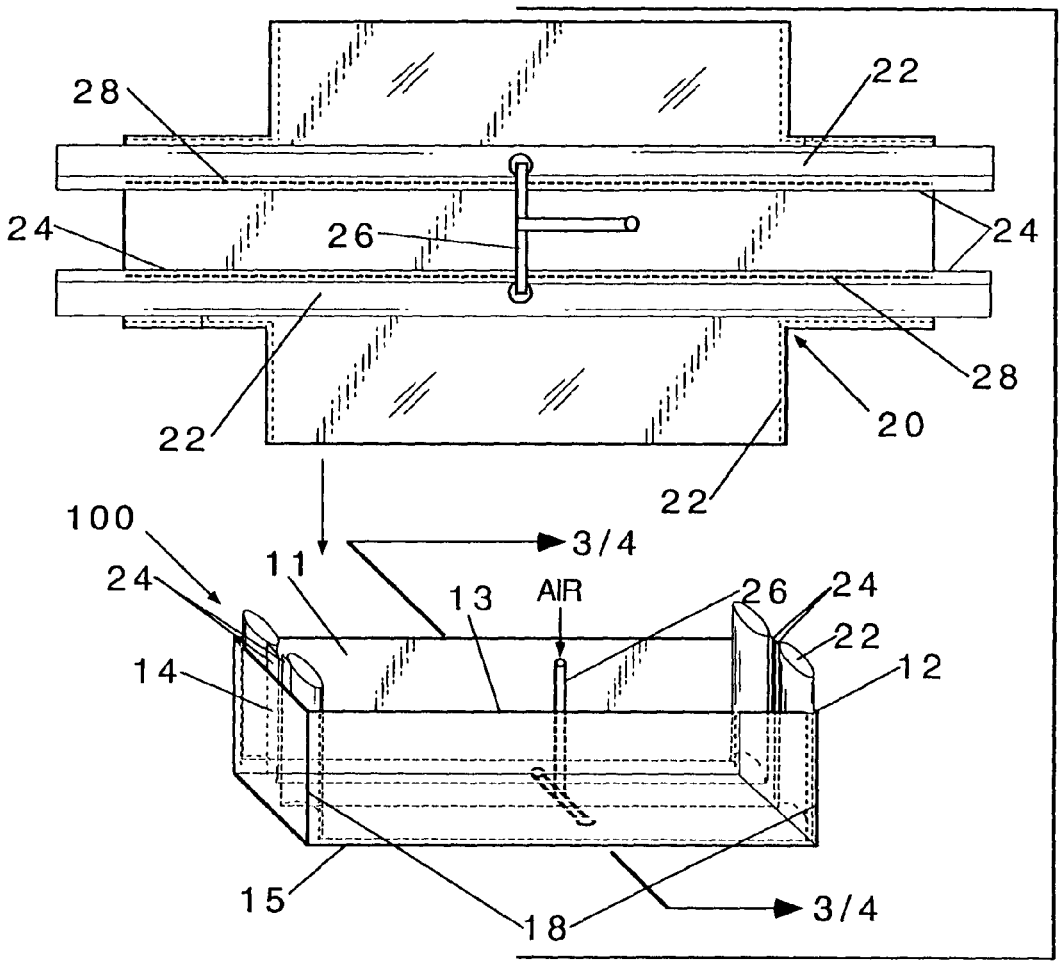
FIG. 2 is a schematic plan view of the making and test deployment of another embodiment of a deployable bag for a container of the invention, where the containment web of the bag is made from one piece, and the deployment system is made separate from and then attached to so that its ribs extend above the web.
Figure 3:
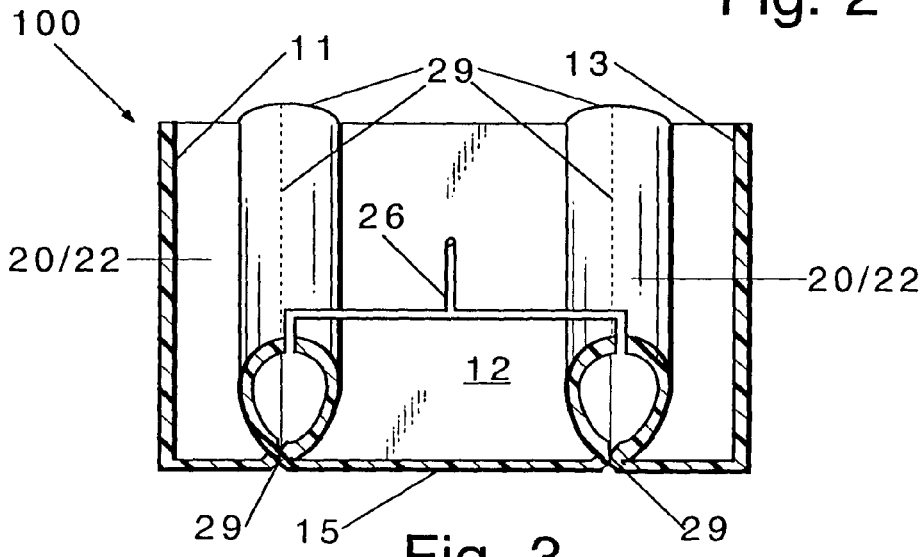
FIG. 3 is a sectional plan view of another embodiment of a deployable bag for a container of the invention, otherwise taken along ¾—¾ of FIG. 2, where the containment web and deployment system ribs of the bag are made from the same piece of material.
Figure 4:
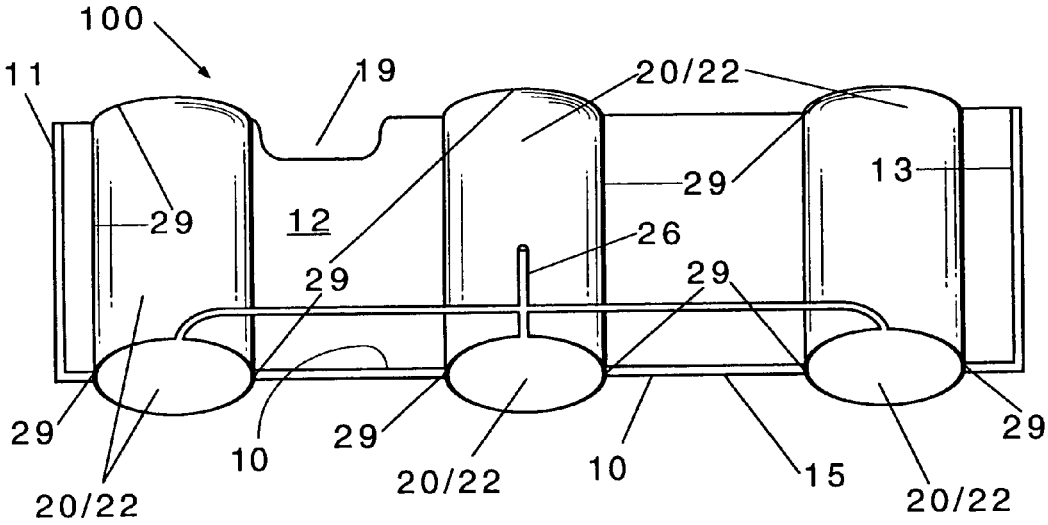
FIG. 4 is a sectional plan view of another embodiment of a deployable bag for a container of the invention, otherwise taken along ¾—¾ of FIG. 2, where the containment web and deployment system ribs of the bag are made from the same pieces of material, embracing two sheets joined together.
Figure 5:
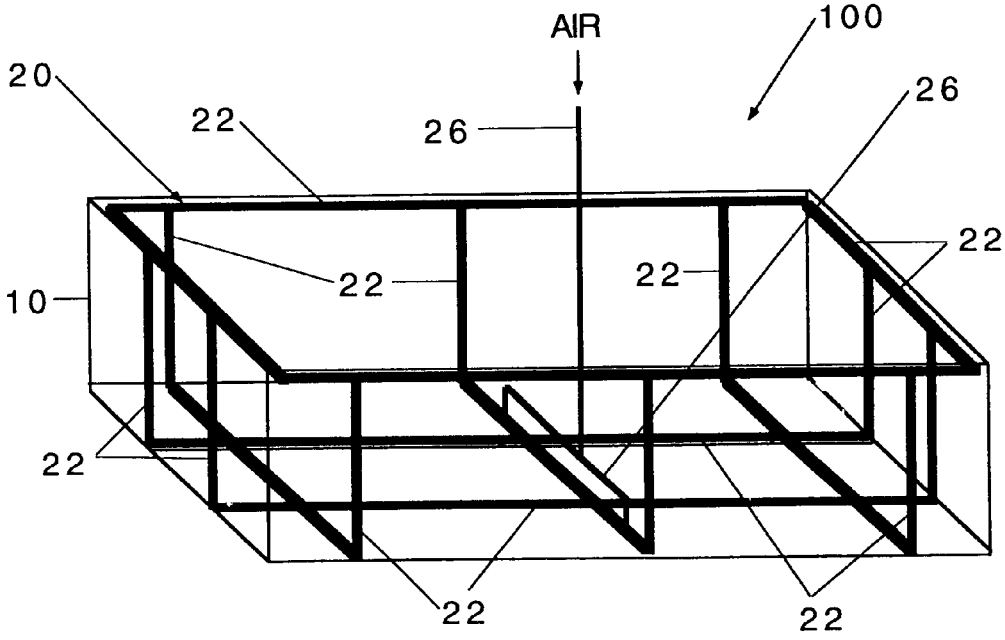
FIG. 5 is a perspective plan view of another embodiment of a deployable bag for a container of the invention, with deployment system ribs positioned more extensively in the containment web.
Figure 6:
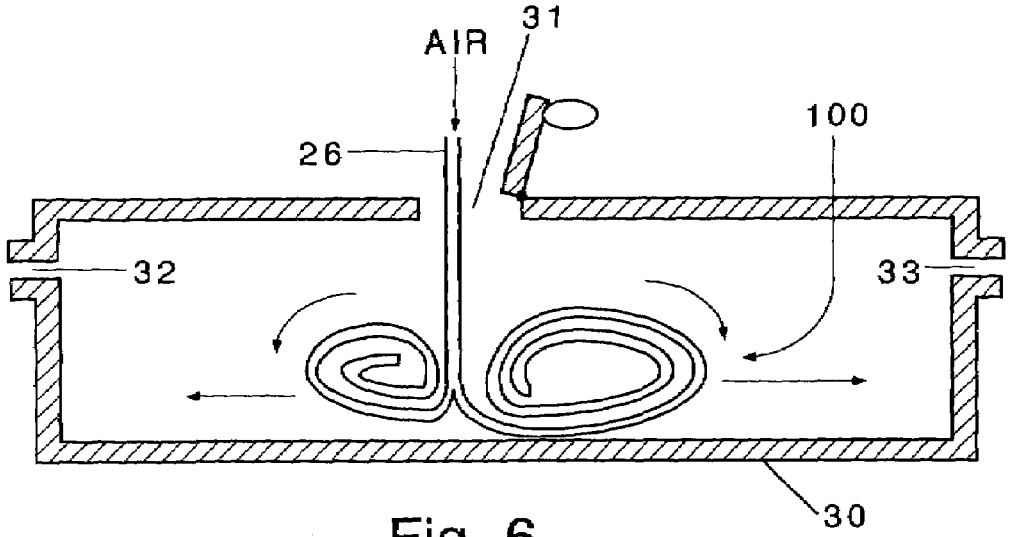
FIG. 6 is a side, sectional view of an embodiment of a deployable bag for a container of the invention, in place in an industrial vacuum box and ready for full deployment.
Figure 7:
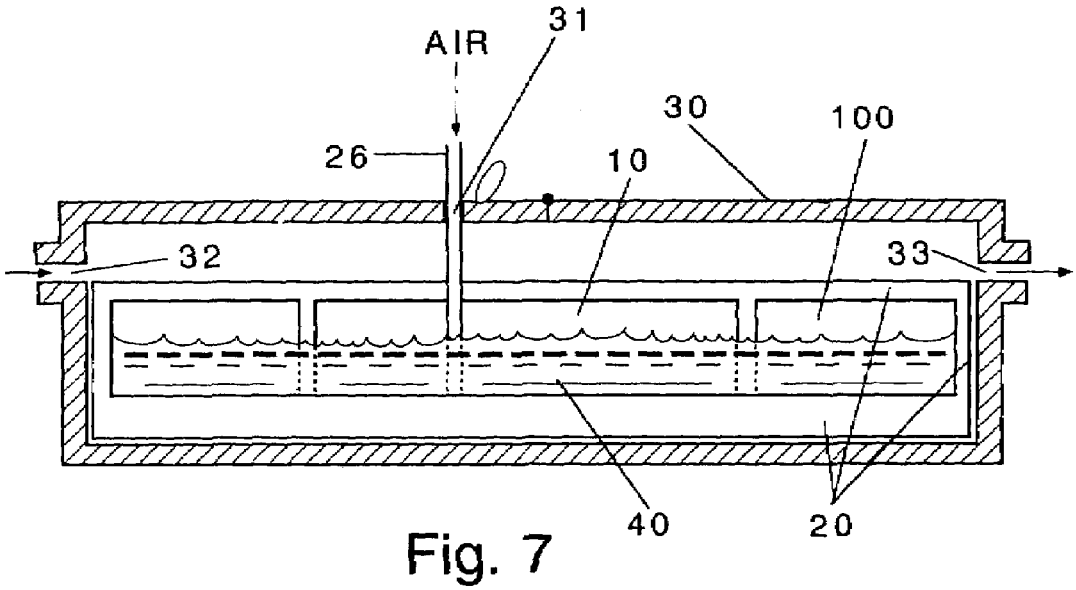
FIG. 7 is a side, sectional view of the embodiment of FIG. 6, fully deployed and in use in the industrial vacuum box of FIG. 6.
Figure 8:
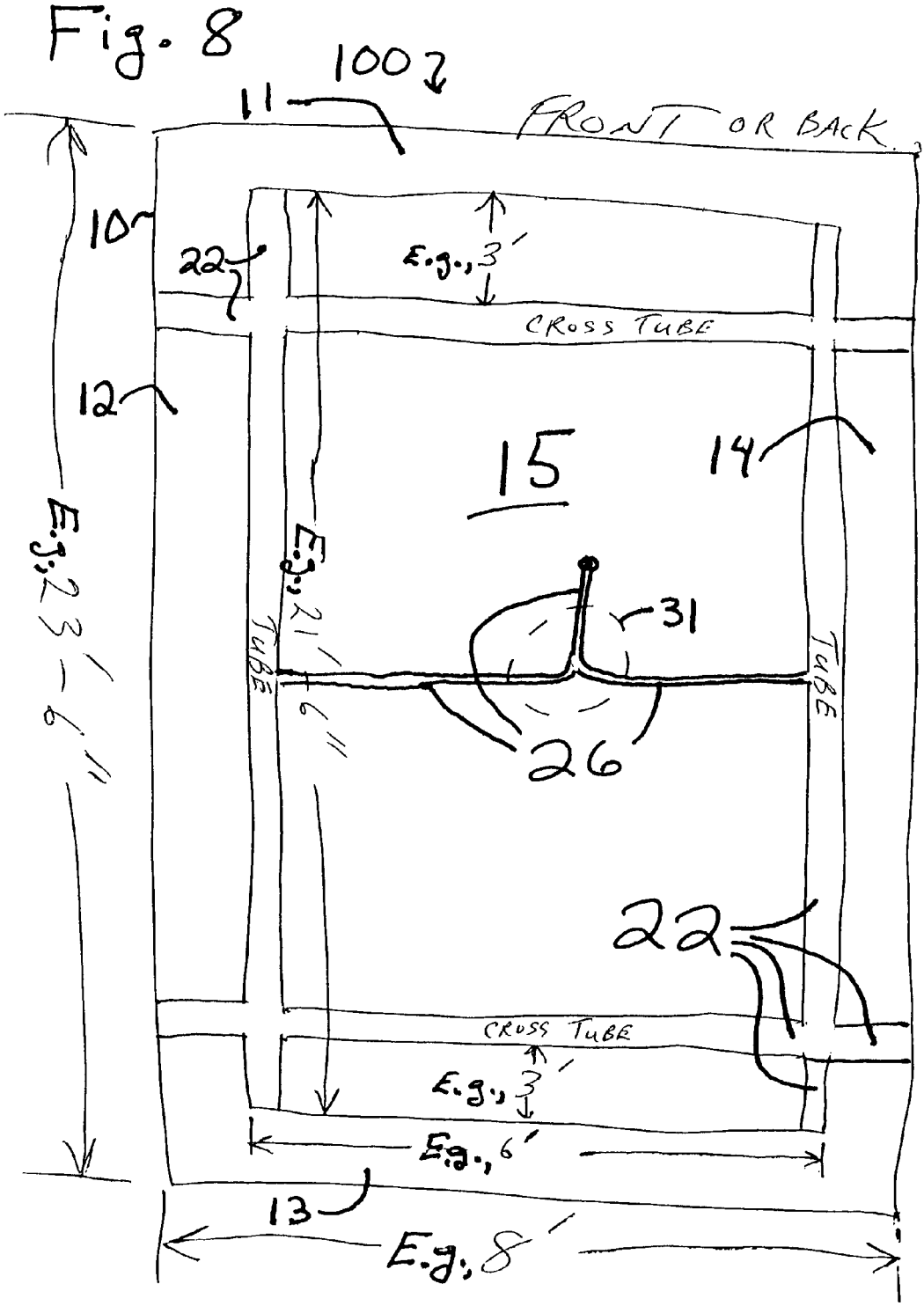
FIG. 8 is a top plan view of another embodiment of a deployable bag for a container of the invention, which is made for a particular style of vacuum box.
Figure 9:
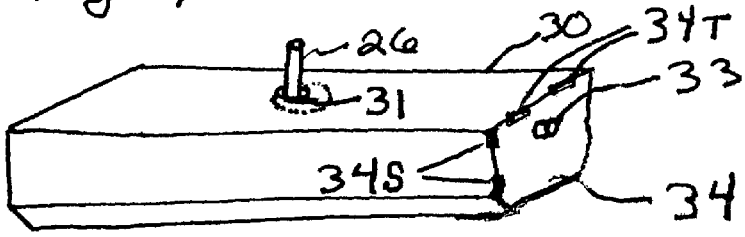
FIG. 9 is a perspective plan view of the bag of FIG. 8, deployed inside the vacuum box for which it is made.
Figure 10:
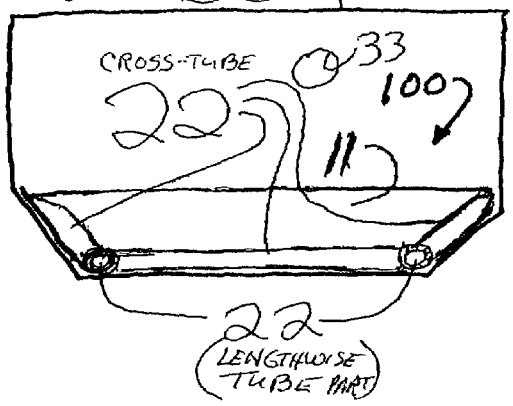
FIG. 10 is a cross sectional plan view of the deployed bag in the vacuum box of FIG. 9, taken along a lengthwise direction.
Figure 11:
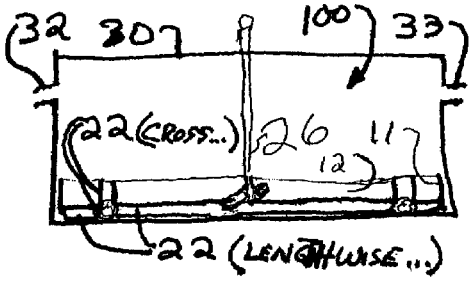
FIG. 11 is a cross sectional plan view of the deployed bag in the vacuum box of FIG. 9, taken along a widthwise direction.
Figure 12:
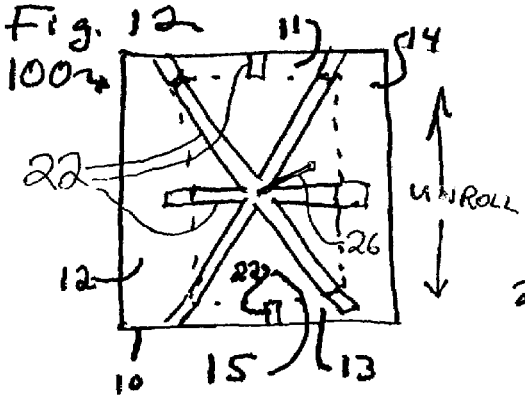
FIG. 12 is a top plan view of another embodiment of a deployable bag for a container of the invention, which has deployment system ribs in an X-type configuration.
Figure 13:
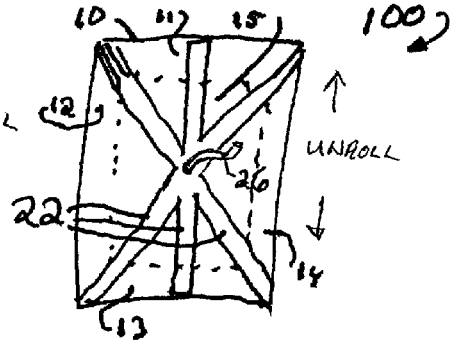
FIG. 13 is a top plan view of another embodiment of a deployable bag for a container of the invention, which has deployment system ribs in another X-type configuration.

The invention can be more fully understood by the following detail, which may be read in view of the drawings. Such is to be taken in an illustrative and not necessarily limiting sense.

In general, the deployable bag for a container includes a containment web and a deployment system. The containment web is made to contain appropriate waste products in the finished bag, and the deployment system is made to deploy or position, or to assist in deploying or positioning, the finished bag in a container generally corresponding in size and shape to the bag. Advantageously, the container is a vacuum box. However, other containers may benefit from employment of the deployable bag of the invention. In particular, industrial containers can benefit, for example, intermodal containers, say, for rail or over the road or on the sea. A particular benefit is that the deployable bag of the invention can be used in containers having confined space difficulties or in which ingress or egress of personnel in setting up other liners in the containers is a problem.

Any suitable material(s) or contrivance(s) may be employed to provide the containment web and deployment system. For instance, the web may be made of a textile or mesh material, say, of cloth, natural and/or synthetic, or even metal, which may be impregnated or coated with a substance resistant to water or other solvent that the finished bag may be expected to contact; a natural or synthetic rubber; and/or a plastic sheet, for example, a polyolefin, say, polyethylene and/or polypropylene, poly vinyl chloride, polytetrafluoroethylene, polystyrene, polyurethane, polysulfide, nylon, polyterephthalate, polysilicone, and so forth and the like, which may or may not be provided with reinforcing fibers. The deployment system, for instance, may be provided by a mechanical system such as the release of springs, extension of booms, say, telescoping and/or folding scissor-like booms; by a closed pneumatic system such as provided through employment of a chemical reaction which releases a gas in a bladder; and/or by an inflatable system such as pumping of a gas, say, air or steam, or a liquid, say, water or hydraulic fluid, in a bladder, and so forth and the like—with the bladders made of any suitable material(s) such as imperforate sheets of an impregnated textile or mesh; a natural or synthetic rubber; and/or a plastic sheet, for example, polyolefin, say, polyethylene and/or polypropylene, poly vinyl chloride, polytetrafluoroethylene, nylon, polystyrene, polyurethane, polysulfide, polyterephthalate, polysilicone, and so forth and the like, which may or may not be reinforced with fibers. The bag can be employed in the container as a liner. An elongate member such as a stick, prod or the like may be used with benefit in positioning the liner before its deployment.

With reference to the drawings, deployable bag 100 for a container includes containment web 10 and deployment system 20. The bag 100 serves as a liner in vacuum box 30 into which industrial waste 40 is conveyed through use of a vacuum.

The containment web 10, which may be made of any suitable material and have any suitable thickness and lateral or vertical component containing dimensions, for instance, a suitable plastic sheet about from two to twenty-five mils thick, for example, a polyethylene sheet about five or six mils thick, which may be reinforced, say, with nylon strands, has sides 11, 12, 13, 14, for example, some two to five feet high, say, about three feet high, and bottom 15, for example, some three to twelve feet in width, say, about seven and one half feet in width, and some ten to fifty feet in length, say, about twenty-three or twenty-six feet in length. When making the web 10 from flat stock, fastenings 18, for example, nylon stitches, can be employed. The fastenings 18 may also be provided by stapling, snapping, hook and loop system such as Velcro (Reg. U.S. Pat. & Tm. Off) material, gluing and/or hot melt welding. As an alternative, the web 10 may be formed into a baglike shape from one piece of material through vacuum molding, or blow or injection molding may be employed to form a one-piece, seamless bag-like web component. Intake or drawthrough port avoidance bay 19 may be provided in a wall such as the wall 12, by any suitable method such as by cutting out material from the wall 12 to form the bay 19.

The deployment system 20, for instance, of the inflatable type, which may be made of any suitable material and have any suitable thickness and area dimensions, for instance, a suitable plastic sheet about from two to twenty-five mils thick, for example, an unreinforced polyethylene sheet about five or six mils thick, may have bladder 22, fastening tab 24 and inflation delivery tube system 26, which may be provided by any suitable device such as flexible tube, rigid or semi-rigid pipe. As an expedient, the system 26 may include standard tire valve stem without the valve, which is attached through the center of a six-inch square piece of one eighth of an inch thick rubber that is fastened to the polyethylene sheet at its bottom end and to which the end of a one quarter inch plastic tube is installed. Of course, the tube or pipe may be otherwise connected to the bladder 22 such as by a direct connection thereto without an intervening standard valve stem, and be heat welded or glued to the sheet at a hole therein. A short stem may simply be molded with, or by heat welding or gluing attached to, the sheet, to which a tube or pipe is later attached to provide the system 26. Although any suitable fluid can serve as an inflation medium, air is preferred. The bladder 22 is typically formed into one or more tubelike ribs, for instance, about from two to five lengthwise ribs which extend lengthwise along the bottom 15 of the web 10 and up the short sides 11, 13; optionally, there may be provided one or more bladder ribs 22, for instance, about from two to ten widthwise ribs which extend widthwise along the bottom 15 of the web 10 and up the long sides 12, 14; and, as a further option, a bladder rib 22 may extend along a part or the whole of the top of the side(s) 11, 12, 13, 14, say, about the top of opposing short sides 11 and 13 or long sides 12 and 14, or about the top of all the sides 11, 12, 13 and 14. The ribs 22 help support the bag 100. To hold the containment web 10 to the deployment system 20, fastenings 28, for instance, stitching, for example, of nylon, can be employed. The fastenings 28 may also be provided by stapling, snapping, hook and loop system such as Velcro (Reg. U.S. Pat. & Tm. Off) material and/or gluing. Hot melt welding 29 may be employed as well, especially to help form the bladder 22 and tab 24, or when the web 10 and bladder 22 are formed from the same piece of material. Again, the web 10 and bladder 22 may be integrally formed from one piece of material.

In use, the bag 100 serves as a liner in the vacuum box 30, which has top access port 31, intake port 32, and drawthrough port 33. The industrial waste 40 is conveyed into the liner 100 in the box 30 through use of a vacuum. When it is time to empty the waste 40, waste 40 and liner 100 together are disposed of through standard emptying door 34, which may open horizontally by swinging on side hinges 34S or vertically by swinging on top hinges 34T.

The present invention is thus provided. Various features, parts, subcombinations and combinations can be employed with or without reference to other features, parts, subcombinations or combinations in the practice of the invention, and numerous adaptations and modifications can be effected within its spirit, the literal claim scope of which is particularly pointed out as follows:

We claim:

1. In combination, a deployable bag and an industrial vacuum box container, wherein:

the deployable bag includes a containment web and a deployment system, wherein the containment web has a bottom and sides, and a size that is at least as extensive as an inner bottom and a lower portion of inner sides of the container in which it is to be employed; and the deployment system embraces an inflatable bladder system that provides a plurality of ribs attached to or integrally part of the web that assist in deploying and supporting the bag, which can be deployed inside the container from a position outside the container when the bag is placed inside the container for deployment therein; and the industrial vacuum box container, inside which said bag resides and which includes the inner bottom and inner sides, further includes an interior defined by the inner bottom, the inner sides, and a top, with an intake port through which industrial waste can be conveyed into the bag in the box through use of a vacuum through a drawthrough port, and a top access port for access to the interior of the container.

2. The combination of claim 1, wherein the inflatable bladder system is pneumatic; the web bottom is at least about three feet wide; and the web sides are at least about two feet high.

3. The combination of claim 2, in which said bag is fully deployed as a liner.

4. The combination of claim 2, wherein the ribs are tubelike; the web bottom is substantially rectangular with a length at least about ten feet; and the inflatable bladder system includes a delivery tube system that has access to the inflatable bladder system substantially central of the web bottom.

5. The combination of claim 4, wherein the ribs form an X-type pattern with respect to the web.

6. The combination of claim 4, wherein the ribs include a plurality of lengthwise ribs that extend lengthwise along the bottom and up short sides of the web.

7. The combination of claim 6, wherein the ribs include a plurality of widthwise ribs that extend widthwise along the bottom and up long sides of the web.

8. The combination of claim 7, wherein the ribs include a top rib along at least a part of a top of at least one of the sides of the web.

9. The combination of claim 7, wherein the top rib extends along the short and long sides of the web.

10. The combination of claim 8, wherein the top rib extends along the short and long sides of the web.

11. The combination of claim 10, wherein the web consists essentially of the bottom and sides, with no top portion thereto; and there are about from two to five lengthwise ribs, and about from two to ten widthwise ribs.

* * * * *